US005212968A

United States Patent [19]

Shima et al.

[11] Patent Number: 5,212,968

[45] Date of Patent: May 25, 1993

[54] PRESSER CONTROLLER OF A CARRIAGE IN A FLAT KNITTING MACHINE

[75] Inventors: Masahiro Shima; Toshinori Nakamori, both of Wakayama, Japan

[73] Assignee: Shima Seiki Mfg., Ltd., Wakayama, Japan

[21] Appl. No.: 723,039

[22] Filed: Jun. 28, 1991

[30] Foreign Application Priority Data

Jul. 4, 1990 [JP] Japan ..... 2-178198

[51] Int. Cl.[5] ..... D04B 15/36

[52] U.S. Cl. ..... 66/78; 66/752

[58] Field of Search ..... 66/75.2, 78

[56] References Cited

U.S. PATENT DOCUMENTS

| | | | |
|---|---|---|---|
| 3,766,754 | 10/1973 | Schieber et al. | 66/78 |
| 3,789,630 | 2/1974 | Schieber et al. | 66/78 |
| 4,004,437 | 1/1977 | Schieber | 66/78 |
| 4,041,732 | 8/1977 | Krause | 66/75.2 |
| 4,364,244 | 12/1982 | Vambutas et al. | 66/75.2 |

FOREIGN PATENT DOCUMENTS 1213446 8/1989 European Pat. Off. .

*Primary Examiner*—Clifford D. Crowder
*Assistant Examiner*—John J. Calvert
*Attorney, Agent, or Firm*—Edwin E. Greigg; Ronald E. Greigg

[57] ABSTRACT

A presser controller device of a carriage in a flat knitting machine in which the carriage comprises: cams that project from the carriage for urging selector jacks of corresponding knitting needles which are parallelly arranged on a needle bed of the traverse knitting machine; cam lift-down plates arranged in parallel therein for actuating their respective cams for upward and downward movement; holding means for holding selected ones of the cam lift-down plates in a given location; springs coupled to their respective cam lift-down plates for constantly urging them in one direction; and actuating means for pressing the cam lift-down plates for displacement while resisting the yielding force of the springs. The actuating means comprise a step motor, a sliding plate for pressing the cam lift-down plates, and a link operating means for transmitting an action of the step motor to the sliding plate so that the cam lift-down plates are moved leftward and rightward while resisting against the yielding force of and together wit the springs respectively by the action of the step motor transmitted via the link operating means and the sliding plate and thus, the cams linked with the cam lift-down plates can project outward from the carriage under control.

2 Claims, 9 Drawing Sheets

PRESSER CONTROLLER OF A CARRIAGE IN A FLAT KNITTING MACHINE

BACKGROUND OF THE INVENTION

The present invention relates to a presser controller device of a carriage in a flat knitting machine.

A prior art presser controller of a carriage in a flat knitting machine is disclosed in Japanese Patent Laid-open Publication 2-14454 (1990). As shown in FIGS. 14 and 15, the carriage 30 has a stitch cam switching lever 31 which can swing during reverse movement of the carriage 30 with its swing member 32 traveling directly on a carriage rail 33. The stitch cam switching lever 31 is coupled to a cam plate 34 which carries a cam 36 provided close to one end thereof for actuation of an L-shaped link arm 37. The link arm cam 36 has a cam slot 35 arranged therein for accepting a cam follower 38 of the L-shaped link arm 37 so that when the stitch cam switching lever 31 performs a swing action, the L-shaped link arm 37 can move on a pivot. The L-shaped link arm 37 is linked at the other end by pivotal coupling to a cam lift-down plate actuator 39 which serves as a member of a presser controller device. The cam lift-down plate actuator 39 is arranged for pressing with its front end against a group of cam lift-down plates 42 from one end. There are provided springs 41 which are coupled at one end to a spring plate 40 fixedly mounted in place and at the other end to their respective cam lift-down plates 42. Each of the cam lift-down plates 42 has a notch 46 arranged in the upper edge thereof for engagement with an L-shaped stopper 45 which is coupled to a solenoid 44 located above each set of cams 43.

In operation, the movement of the cam plate 34 driven by the stitch cam switching lever 31 triggers the pivotal action of the L-shaped link arm 37 through the cam follower 38 moving along the cam slot 35 of the link arm cam 36. Accordingly, the cam lift-down plate actuator 39 moves forward against the yielding force of the springs 41, pressing out the cam lift-down plates 42. Then, desired ones of the solenoids 44 are energized for actuating their stoppers 45 to move into the notches 46 of the corresponding cam lift-down plates 42 so that the desired cams 43 can project outward.

However, such a prior art presser controller having the foregoing arrangement allows the cam lift-down actuator 39 to be driven by the action of the stitch cam switching lever 31 which may be affected by friction resistance between the swing member 32 and the carriage rail 33 thus causing a jerky movement of the cam plate 34. As the result, a constant, accurate operation of the presser control will rarely be executed.

Also, the prior art presser controller is easily affected by external factors and will thus operate without higher accuracy and consistency. This causes the operating solenoids 44, which have been selected and turned on for engagement of their stoppers 45 with the notches 46 of the corresponding cam lift-down plates 42, to remain energized constantly for ensuring the engagement. If the energization of the solenoids 44 is inactivated, the relevant cams 43 will retract into the carriage 30 upon the reverse movement of the carriage 30 manually actuated by an operator for replacement of a broken knitting needle with a new one.

For eliminating the foregoing drawbacks, the present invention has been invented through continuation of research and development. It is thus an object of the present invention to provide a presser controller device of a carriage in a flat knitting machine which contains an independent mechanism provided with a step motor for cam control so that desired cams can be actuated with more accuracy without using an intricate conventional system.

SUMMARY OF THE INVENTION

A presser controller device of a carriage in a flat knitting machine according to the present invention is arranged in which the carriage comprises: cams for when projecting from the carriage, urging selector jacks of corresponding knitting needles which are parallelly arranged on a needle bed of the traverse knitting machine; cam lift-down plates arranged in parallel therein for actuating their respective cams for upward and downward movement; holding means for holding selected ones of the cam lift-down plates in a given location; springs coupled to their respective cam lift-down plates for constantly urging them in one direction; and actuating means for pressing the cam lift-down plates for displacement as resisting against the yielding force of the springs. In particular, the actuating means comprises a step motor, a sliding plate for pressing the cam lift-down plates, and a link operating means for transmitting an action of the step motor to the sliding plate so that the cam lift-down plates are moved leftward and rightward as resisting against the yielding force of and together with the springs respectively by the action of the step motor transmitted via the link operating means and the sliding plate and thus, the cams linked with the cam lift-down plates can project outward from the carriage under control.

Also, as depicted herein, the springs for urging the cam lift-down plates are divided into upper and lower groups. One of the upper and lower group springs are coupled at one end to their respective cam lift-down plates and at the other end to a stationary retainer fixedly mounted to a given location of the carriage and the other group springs are coupled at one end to their respective cam lift-down plates and at the other end to one end or the opposite end to the pressing end of the sliding plate. In addition, the link operating means for transmitting the action of the step motor is coupled to the sliding plate so that the cam lift-down plates are moved by the sliding plate, which is actuated via the link operating means by the action of the step motor, as resisting against the yielding force of either the upper or lower group of the springs.

Accordingly, when the carriage running leftward and rightward over the needle bed of the traverse knitting machine comes to a predetermined position for reverse action, its step motor starts rotating and actuates, via the link operating means, the sliding plate to advance towards and press the cam lift-down plates against the yielding force of the springs. Then, desired ones of the cam lift-down plates are held at the holding position by the holding means disposed above the cam lift-down plates. As the step motor continues rotating, the sliding plate is returned backward to the original position and thus, the remaining cam lift-down plates which are not restricted by the holding means are moved backward by the yielding force of the springs to their original position.

When the springs for urging their respective cam lift-down plates are divided into the upper and lower groups, the cam lift-down plates are driven while resisting against the yielding force of either the upper or lower group of the springs. Accordingly, for returning to the original position without restriction by the holding means, some of the cam lift-down plates coupled to the springs secured to the stationary retainer will be urged by the same and the remaining cam lift-down plates coupled to the springs secured to the sliding plate will be moved backward as the sliding plate travels backward.

As the result, desired cams linked with their respective cam lift-down plates can controllably be actuated for projecting action.

DESCRIPTION OF THE PREFERRED EMBODIMENT

Figure 1:
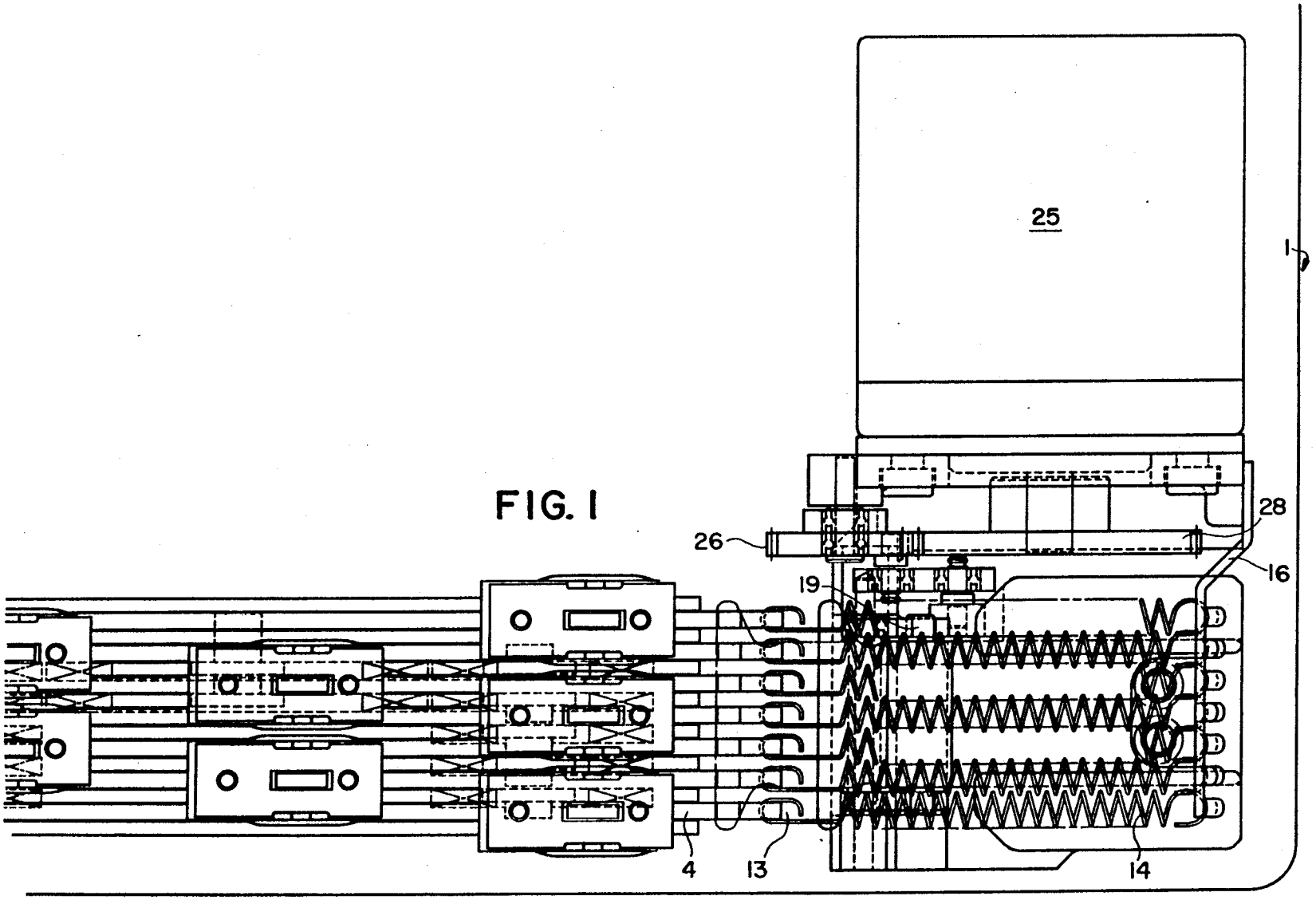
FIG. 1 is a plan view of a primary part of a presser controller device according to the present invention.

One preferred embodiment of the present invention will be described referring to FIGS. 1 to 13.

A presser controller device 1 of the embodiment is mounted onto a carriage, which is provided in a flat knitting machine for left- and rightward movement over a needle bed carrying a multiplicity of parallelly arranged knitting needles, for actuating cams, described later, to project downward from the carriage and urge corresponding selector jacks (not shown) which in turn control the action of knitting needles.

More specifically, the presser controller 1 has a base plate 3 arranged beneath the carriage and having a plurality of openings 2 for outward projection of cams 6 for urging their respective selector jacks. A plurality of equally spaced cam lift-down plates 4 are arranged above the base plate 3 or inside the carriage for movement left- and rightwardly of the carriage along the openings 2. In this embodiment the cam lift-down plates 4 total seven. Each of the seven cam lift-down plates 4 has a cam slot 5 of lift-up shape (see FIG. 2) arranged in a predetermined location thereof for accepting a pin 7 of the corresponding cam 6 which will thus urge the selector jacks when moving downward. The cam lift-down plate 4 also a notch 8 arranged in the upper edge thereof above the cam slot 5 for engagement of a stopper 9 which will be described later in more detail.

A holding means 10 is provided above the notch 8 of each cam lift-down plate 4, comprising the L-shaped stopper 9 and a solenoid 11. The stopper 9 is coupled to a rocking plunger 12 of the solenoid 11 for pivotal movement. When the solenoid 11 is energized, its rocking plunger 12 actuates the stopper 9 to move into the notch 8 thus holding the cam lift-down plate 4.

The seven cam lift-down plates 4 have spring hooks 13 thereof respectively: four at the top of the proximal end and three at the lower-than-top of the proximal end. Each spring hook 13 holds one end of an extension spring 14. Hence, the seven springs 14 are mounted in two heights, four in the upper and three in the lower. The four or upper springs 14 are coupled at the other end to a stationary retainer 16 mounted on the front side end of a step motor described later. Thus, the four cam lift-down plates 4 remain urged towards the stationary retainer 16 by the yielding force of their respective upper springs 14.

On the other hand, the three or lower springs 14 on the remaining cam lift-down plates 4 are coupled at the other end to a movable retainer 17 which is mounted in upright arrangement to one end of a sliding plate 18 slidably sustained above the base plate 3. The sliding plate 18 is slidable towards the cam lift-down plates 4 so that it can press against all the seven cam lift-down plates 4 at once. Also, the sliding plate 18 carries at the cam lift-down plate side a link member 20 which has a couple of pins 19 mounted on both sides thereof.

Each of the two pins 19 of the link member 20 is arranged for engagement with a recess 23 of a swing member 22. The two, left and right, swing members 22 are pivotably mounted on a support 21 disposed on the base plate 3. One of the two swing members 22 being engaged with the pin 19 has an approximately triangle shape and is linked to the lower end of an actuating link rod 24. The upper end of the actuating link rod 24 is pivotably coupled to the front face of a small toothed wheel 26 which is mounted on the front end of the step motor 25 for rotation. The small toothed wheel 26 is meshed with a large toothed wheel 28 fixedly mounted on a shaft 27 of the step motor 25.

Accordingly, a driving means for transmitting power from the step motor 25 to the sliding plate 18 comprises the pins 19, the link member 20, the support 21, the swing members 22, the actuating link rod 24, the small toothed wheel 26, and the large toothed wheel 28.

In operation of the presser controller 1 having the foregoing arrangement as shown in FIGS. 4 to 13, the step motor 25 in the carriage is controlled and activated by an electrical signal when the carriage which travels leftward and rightward over the needle bed comes at a given location for reverse movement. Then, the large toothed wheel 28 fitted on the motor shaft 27 starts rotating clockwise and actuates the small toothed wheel 26 to rotate counter-clockwise. As the rotating movement of the small toothed wheel 26 lifts up the actuating link rod 24, the swing members 22 turn counter-clockwise. Hence, the sliding plate 18 is advanced towards the cam lift-down plates 4 by the action of the swing members 22 which is transmitted via the two pins 19 of the link member 20 engaged with their respective swing members 22.

Figure 10:
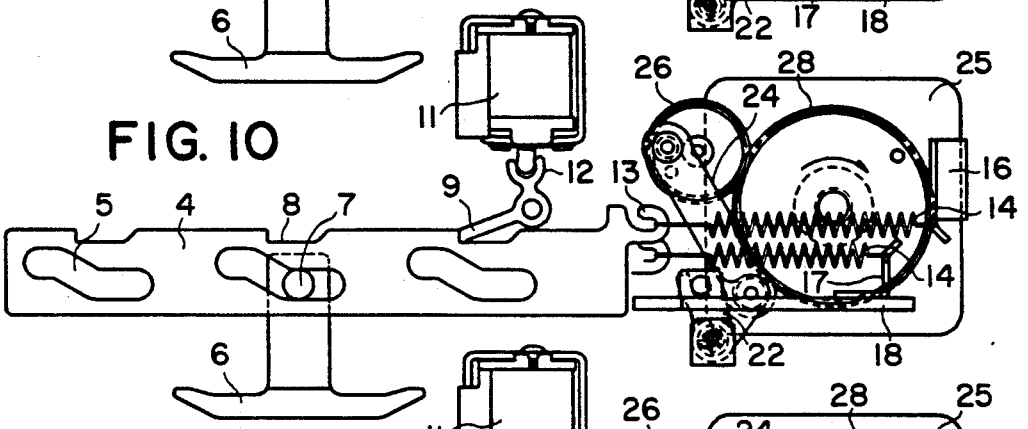
Figure 11:
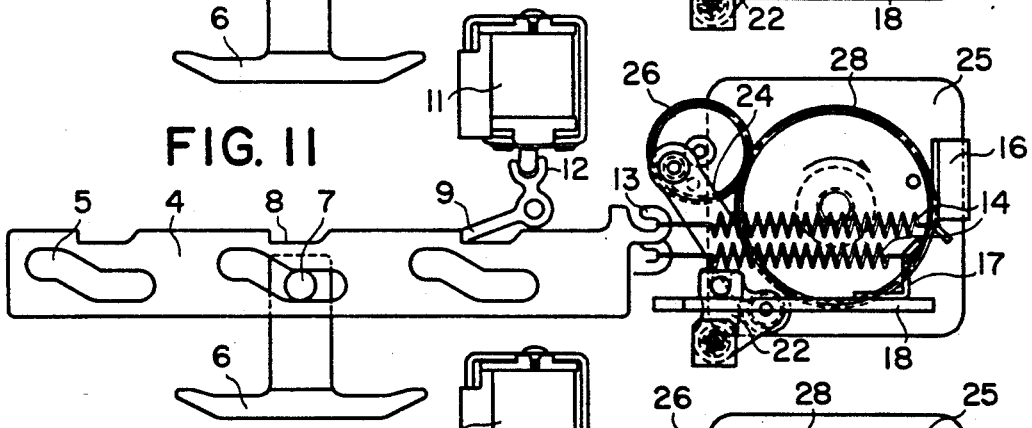
Figure 12:
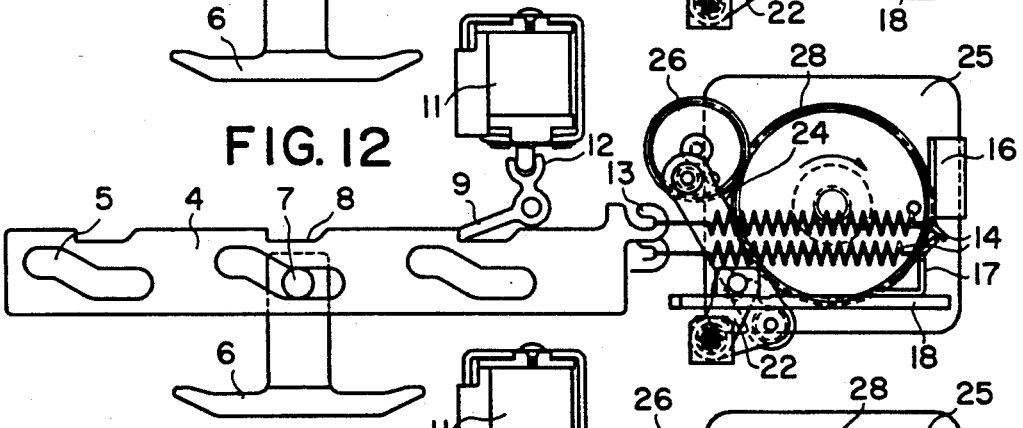
Figure 13:
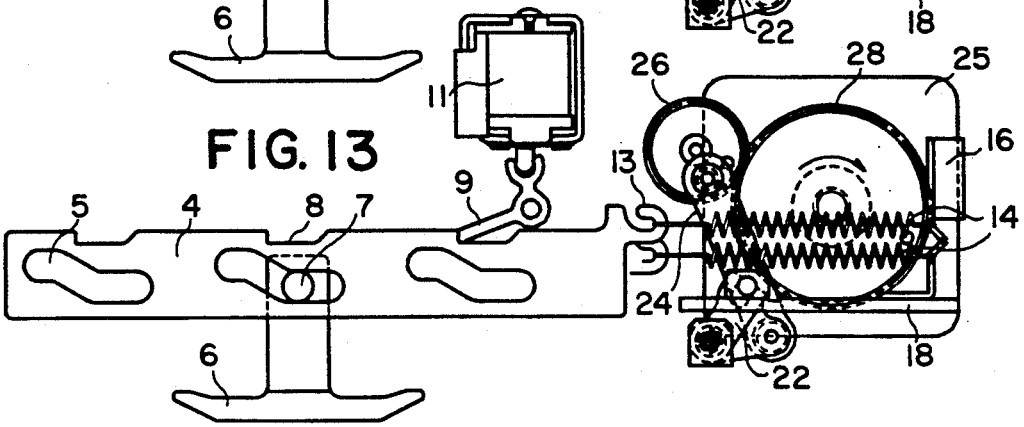
Figure 14:
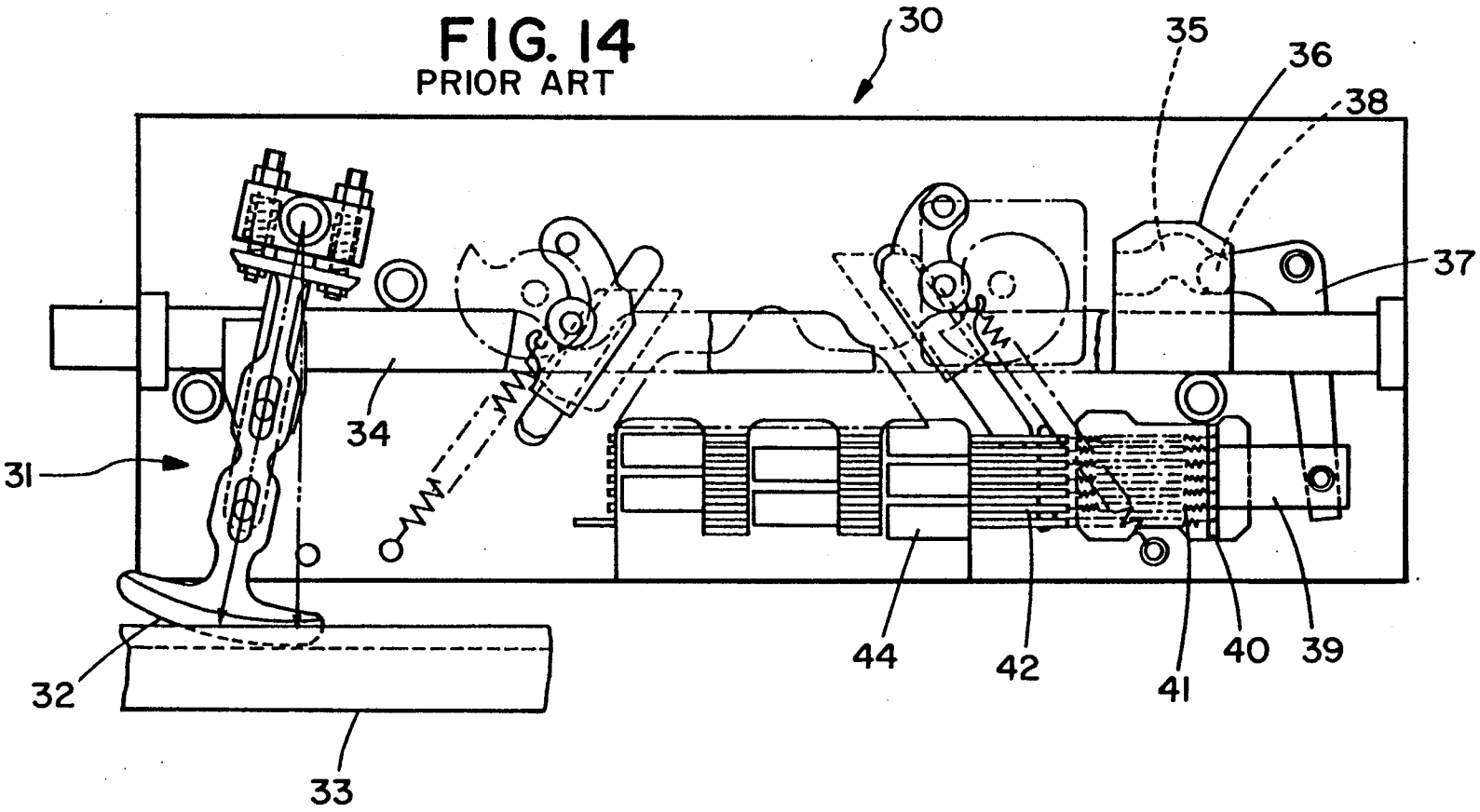
FIG. 14 PRIOR ART
FIG. 14 is an explanatory view showing a prior art presser controller.
Figure 15:
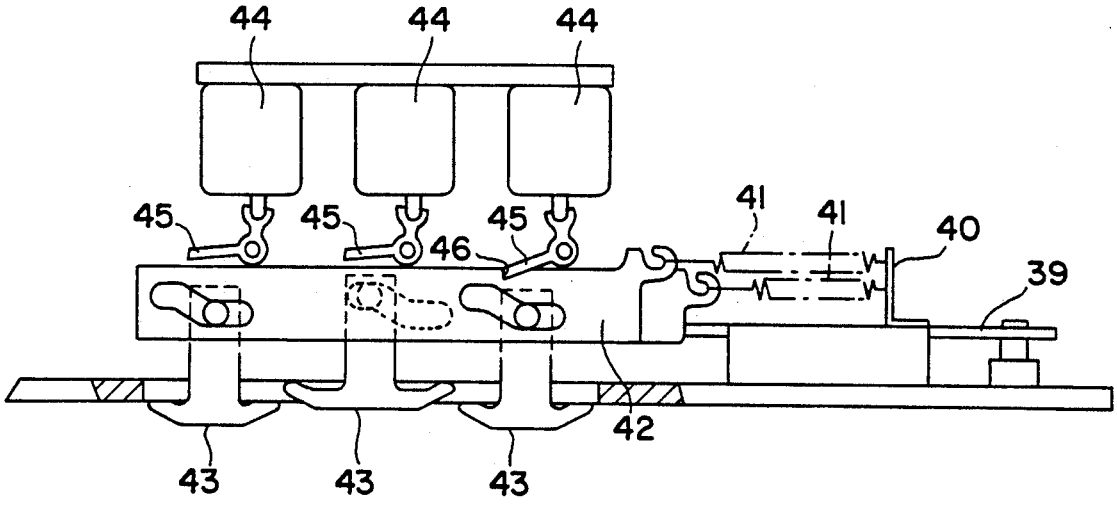
FIG. 15 PRIOR ART
FIG. 15 is a front view of a cam section of the prior art presser controller.

As shown in FIGS. 4 to 8, the sliding plate 18 and the movable retainer 17 are moved leftward as the small toothed gear 26 rotates by means of a step motor 25. Being pushed by the sliding plate 18, the cam lift-down plates 4 are moved leftward and the pins 7 are pushed downward along the cam slots 5. When the procedure comes to FIG. 8, the stoppers 9 are actuated to move into the notches by operation of the solenoids controlled by an electrical signal. In FIGS. 10- to 13, the sliding plate 18 and the movable retainer 17 are moved rightward, while the cam lift-down plates 4 remain in the same position as that in FIG. 9 because the stoppers 9 prevent the cam lift-down plates 4 from moving back rightward to the original position.

At the time, the lower springs 14 coupled to the movable retainer 17 are also moved towards the cam lift-down plates 4 together with the sliding plate 18. This allows the sliding plate 18 to resist against the yielding force of the upper four springs 14 during pressing on the cam lift-down plates 4 and thus, less load is expected on the step motor 25. Accordingly, the step motor 25 on the carriage can be made for a smaller power output. In the prior art, all seven of the sliding plates have to resist a yielding force of all of the seven springs whose ends are coupled to the stationary retainer; therefore, less power output is required because the sliding plate 18 only has to resist the yielding force of the upper four spring 14 whose ends are coupled to the stationary retainer 16. The other three springs 14 are not fixed to the stationary retainer 16 but are coupled to the movable retainer 17 and do not apply a spring force against the motor.

Figure 2:
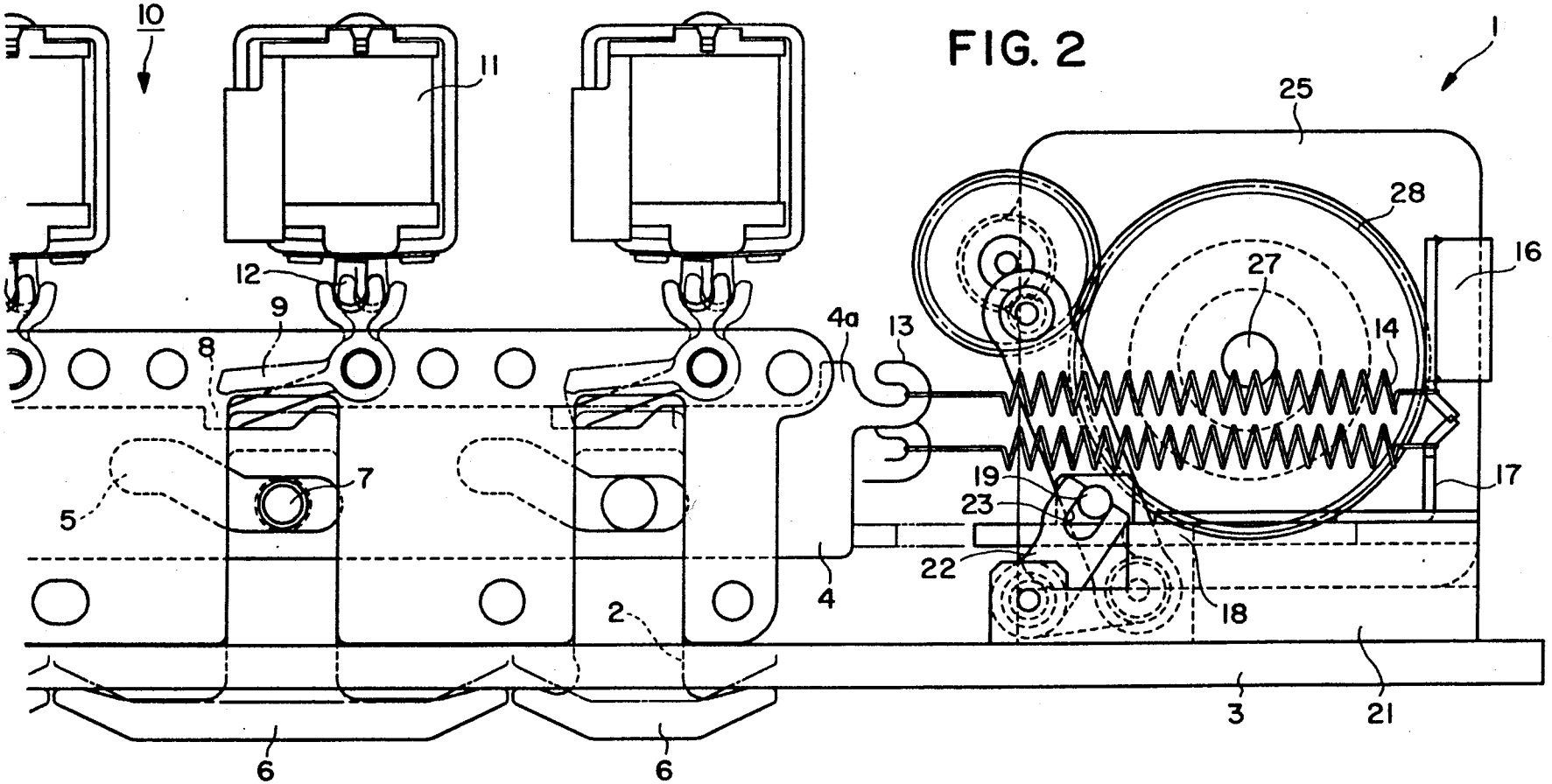
FIG. 2 is a front view of the same.
Figure 3A:
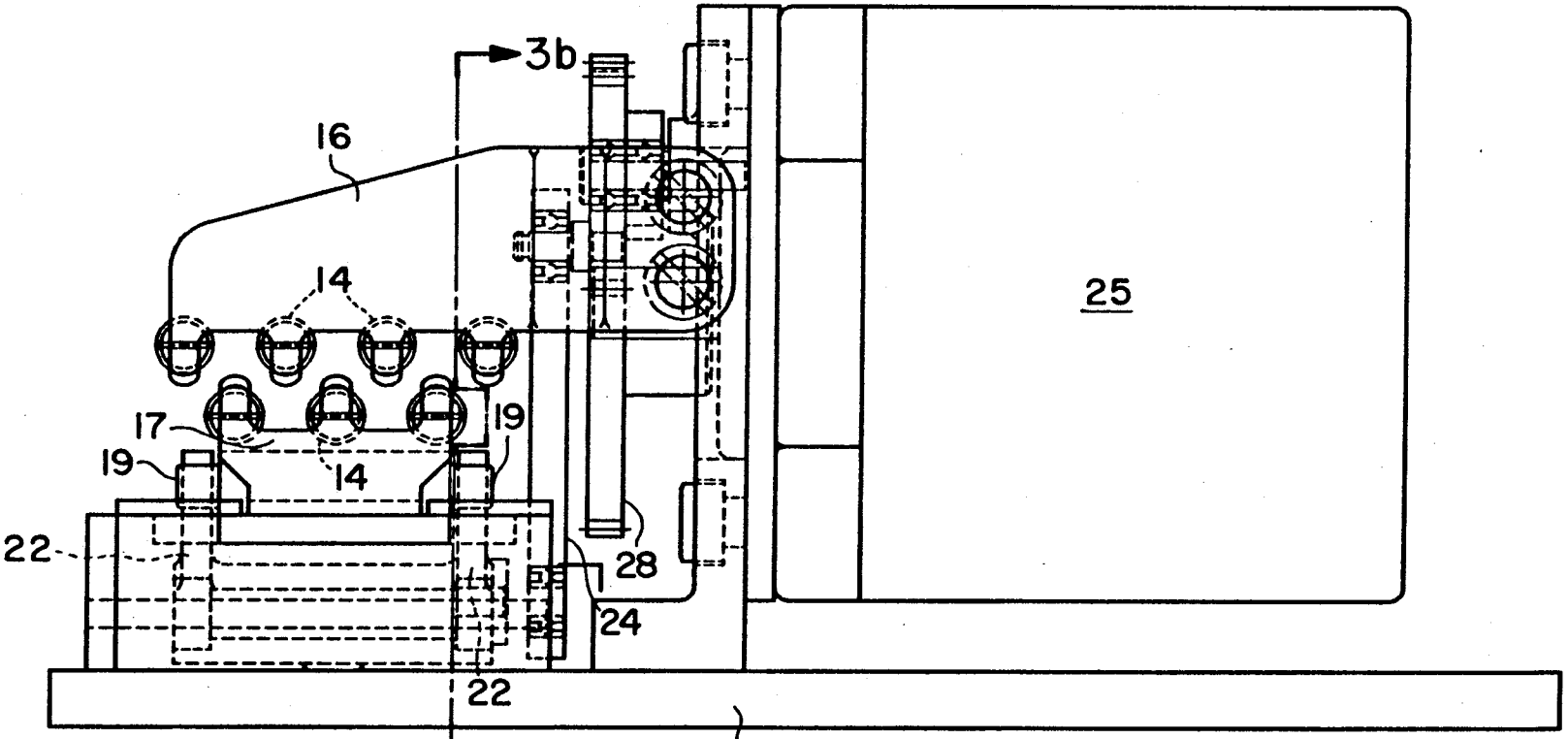
FIG. 3*a* is a side view of the same.
Figure 3B:
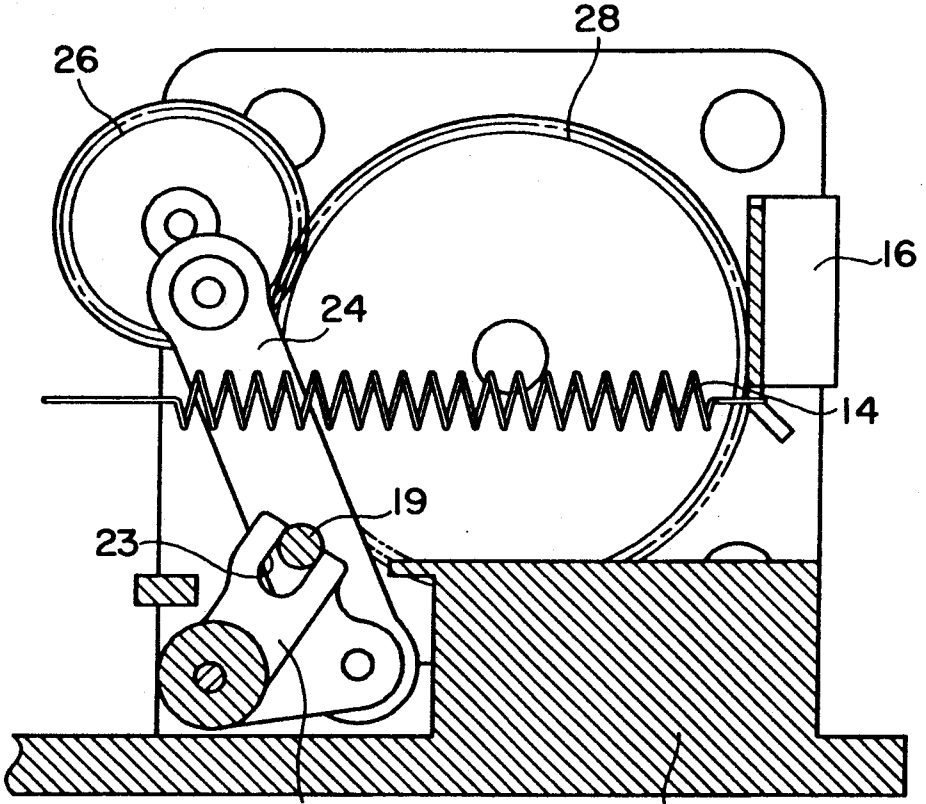
FIG. 3*b* is a cross sectional view of FIG. 3*a* along lines 3*b*—3*b;*
Figure 3C:
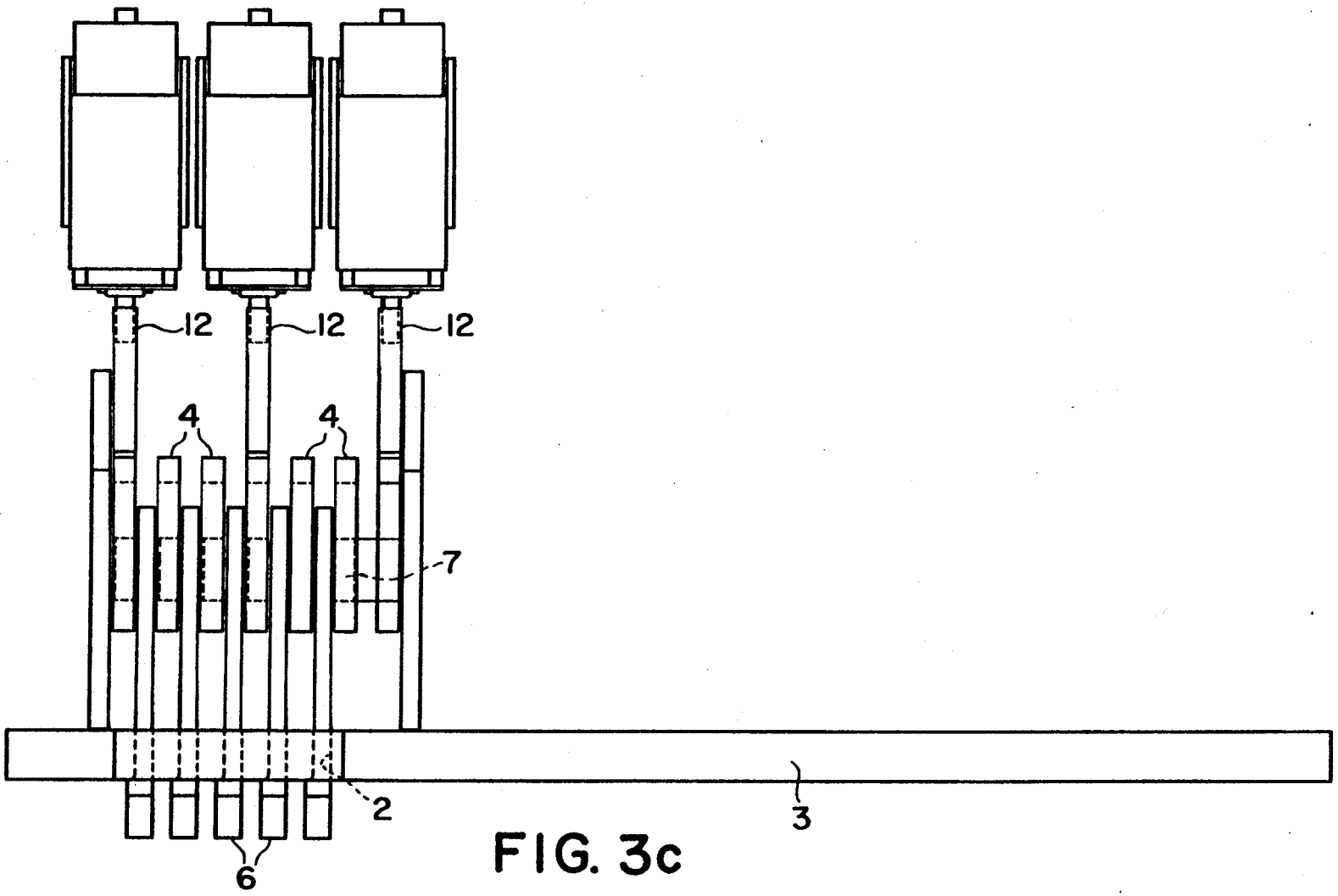
FIG. 3*c* is an end view of a portion of the device illustrating solenoid operated lift-down plates and cams.
Figure 4:
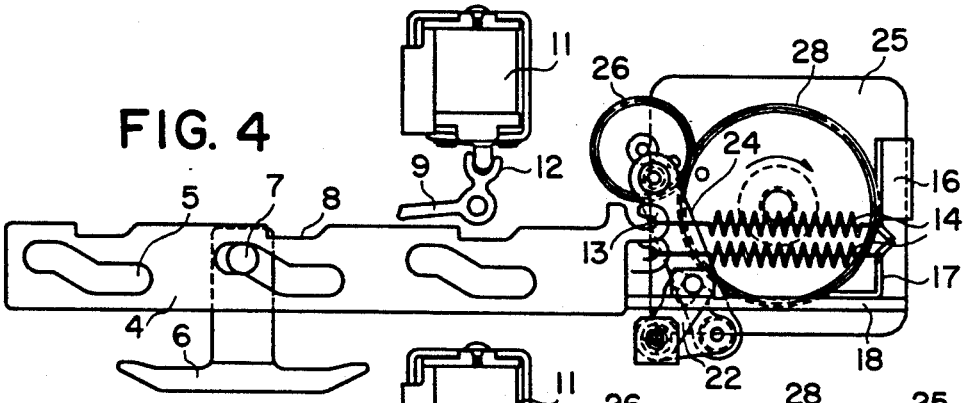
FIGS. 4 to 13 are explanatory views showing an operation of the same.
Figure 5:
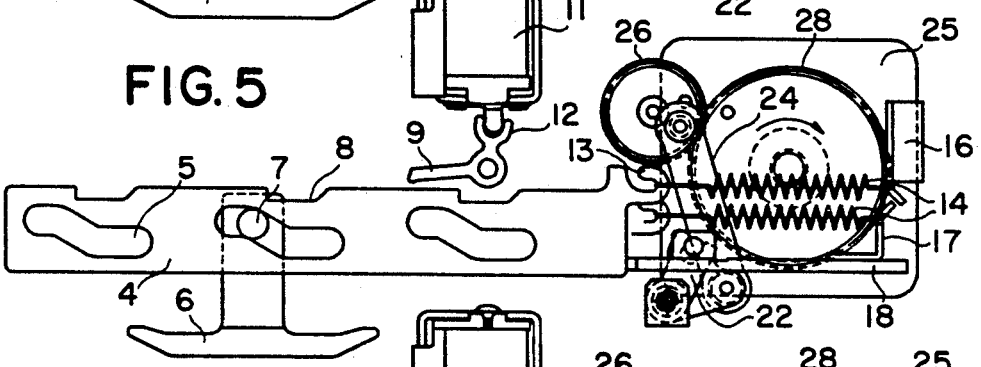
Figure 6:
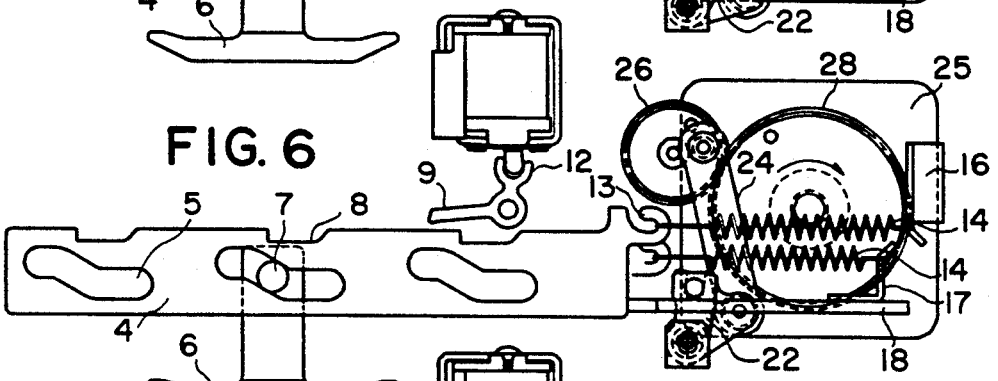
Figure 7:
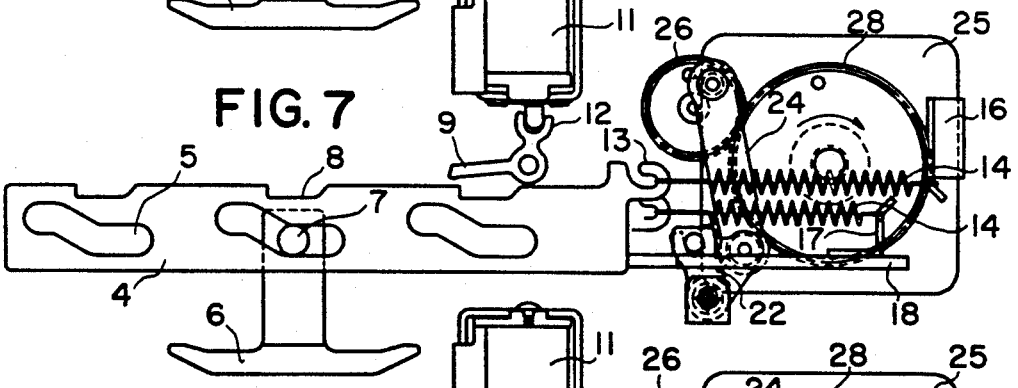
Figure 8:
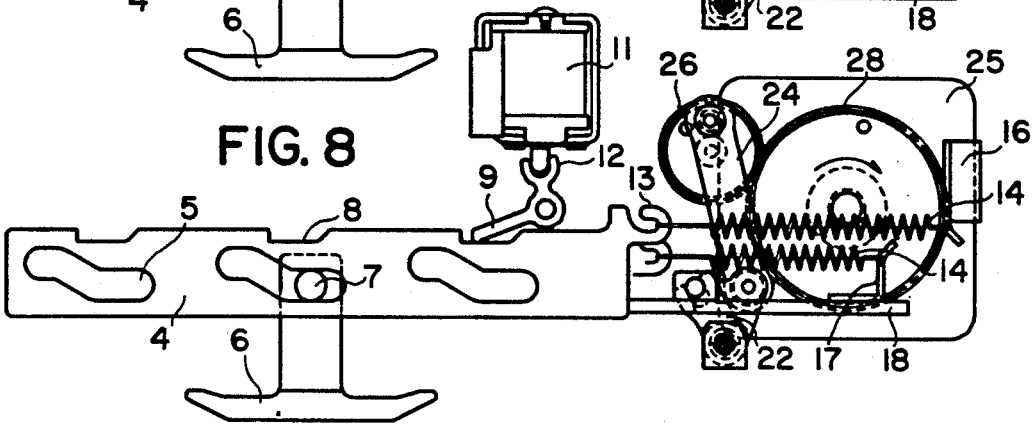
Figure 9:
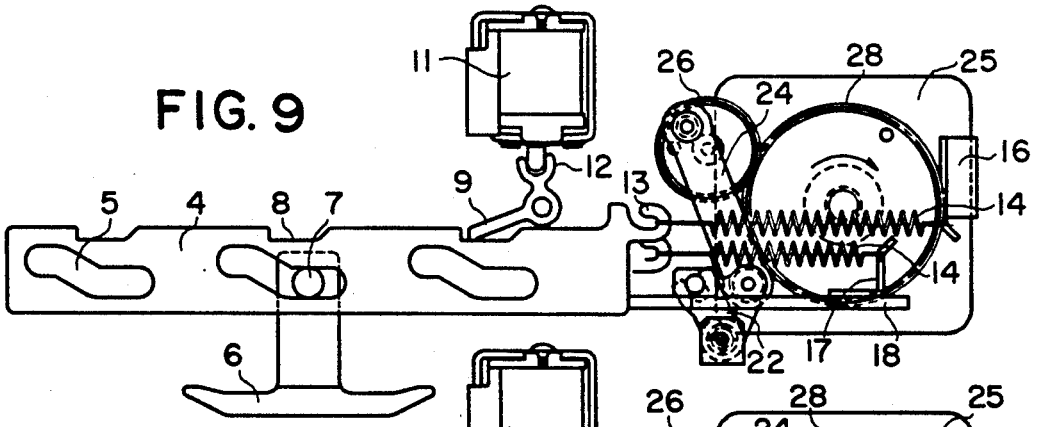

When the cam lift-down plates 4 are displaced to the left in FIG. 1 or 2, the cams 6 engaged by their pins 7 with the cam slots 5 of the cam lift-down plates 4 project outward from the openings 2 of the base plate 3. Then, desired ones of the solenoids 11 are energized for actuating their respective stoppers 9 to move into the notches 8 of the corresponding cam lift-down plates 4 for holding the cam lift-down plates. The solenoids are controlled by the electrical signal for operation as required during the knitting process.

Meanwhile, the step motor 25 continues to rotate thus actuating the sliding plate 17 to slide forward (or advance) to a given position and then, backward (or return) to the original position. The cam lift-down plates 4 which are not restricted by the stoppers 9 are then moved rightward or backward by the yielding force of the springs 14 as following the sliding plate 17 and their corresponding cams 6 retract back into the carriage. The cams 6 linked with the restricted cam lift-down plates 4 remain projected outward from the bottom of the base plate 3 so that they can urge their respective selector jacks.

While the sliding plate 17 reaches the original position with the movable retrainer 17 tensioning the engaged springs 14, the restricted cam lift-down plates 4 remain spaced from the sliding plate 17. Consequently, the procedure of presser control is completed in an independent manner with no linkage to the other mechanism of the carriage.

It wound be understood that the present invention is not limited to the foregoing embodiment. All the springs 14 coupled to the cam lift-down plates 4 may be secured to the stationary retainer 16 or the movable retainer 17 on the sliding plate 18.

The foregoing relates to preferred exemplary embodiments of the invention, it being understood that other variants and embodiments thereof are possible within the spirit and scope of the invention, the latter being defined by the appended claims.

What is claimed is:

1. A flat knitting machine comprising:

a presser controller device for a carriage of said flat knitting machine;

selector jacks of corresponding knitting needles which are arranged in parallel on a knitting bed of said flat knitting machine;

cams that project from said carriage which urge said selector jacks of said corresponding knitting needles;

cam lift-down plates arranged in parallel in said carriage for actuating their respective cams for upward and downward movement;

holding means for holding selected ones of the cam lift-down plates in a given location;

spring means coupled to respective cam lift-down plates for constantly urging said cam lift-down plates in one direction;

actuating means for pressing the cam lift-down plates for displacement against the yielding force of the springs; and said actuating means comprises a step motor, a sliding plate for pressing the cam lift-down plates, and a link operating means for transmitting an action of the step motor to the sliding plate so that the cam lift-down plates are moved leftward and rightward against a yielding force of and together with the springs respectively by an action of the step motor transmitted via the link operating means and the sliding plate and thus, the cams linked with the cam lift-down plates can project under control outward from the carriage.

2. A flat knitting machine according to claim 1, wherein the springs for urging the cam lift-down plates are divided into upper and lower groups, one of the upper and lowr groups of the springs being coupled at one end to their respective cam lift-down plates and at the other end to a stationary retainer fixedly mounted to a given location of the carriage and the other group of the upper and lower springs being coupled at one end to their respective cam lift-down plates and at the other end to the pressing end of a sliding plate, and the link operating means for transmitting the action of the step motor is coupled to the sliding plate so that the cam lift-down plates are moved by the sliding plate, which is actuated via the link operating means by the action of the step motor, against the yielding force of either the upper or lower group of the springs.

* * * * *